US007473098B1

(12) United States Patent
Poulos

(10) Patent No.: US 7,473,098 B1
(45) Date of Patent: Jan. 6, 2009

(54) ROTATABLE AUDIO AND MUSICAL INSTRUMENT CABLE

(76) Inventor: Anthony Poulos, 12885 Quito Rd., Saratoga, CA (US) 95070

( * ) Notice: Subject to any disclaimer, the term of this patent is extended or adjusted under 35 U.S.C. 154(b) by 0 days.

(21) Appl. No.: 11/985,739

(22) Filed: Nov. 16, 2007

(51) Int. Cl.
*H01R 29/00* (2006.01)

(52) U.S. Cl. ..... 439/21; 439/669

(58) Field of Classification Search ..... 439/21, 439/39, 669
See application file for complete search history.

(56) References Cited

U.S. PATENT DOCUMENTS

| | | | | |
|---|---|---|---|---|
| 1,178,267 | A | 4/1916 | Scheel | |
| 2,823,358 | A * | 2/1958 | Means et al. | 333/105 |
| 3,437,976 | A | 4/1969 | Nelson | |
| 3,972,577 | A * | 8/1976 | Charles et al. | 439/21 |
| 3,993,970 | A * | 11/1976 | Brownell | 335/5 |
| 4,166,666 | A * | 9/1979 | Reese | 439/179 |
| 4,273,969 | A | 6/1981 | Foley | |
| 4,557,536 | A | 12/1985 | Geurts | |
| 4,590,337 | A | 5/1986 | Engelmore | |
| 4,850,880 | A | 7/1989 | Zayat, Jr. | |
| 4,894,014 | A | 1/1990 | Palus | |
| 5,074,796 | A | 12/1991 | Carter | |
| 5,180,317 | A | 1/1993 | Franks, Jr. | |
| 5,419,707 | A | 5/1995 | Kelley | |
| 7,354,315 | B2 * | 4/2008 | Goetz et al. | 439/669 |

OTHER PUBLICATIONS

Mod-Tronic Instruments Limited,Low cost Slip Ring—Mercotac Model 205, internet catalog site located at www.mod-tronic.com/Mercotac_205.html, Jul. 2005.

* cited by examiner

*Primary Examiner*—Briggitte R Hammond

(57) ABSTRACT

A musical instrument cable that is functional for use while walking around and playing an electric guitar or other electric instrument. This provides the user with a freely rotatable and noiseless solution to old style cables which twist up during use and eventually break down due to mechanical fatigue of the internal wiring. Using a typical audio connector plug 10 on one end and connecting to a length of coaxial cable 12 with enough length to strain relief a loop of cable through the guitar strap and butt end of the instrument, the cable is then connected to a rotatable electrical connector 16. The connector 16 internally uses mercury to make the electrical connection between the moving contacts within the connector 16. The other end of the connector 16 then attaches to another length of cable 12 and to another connector plug 10 on the end of the cable 12.

6 Claims, 3 Drawing Sheets

ROTATABLE AUDIO AND MUSICAL INSTRUMENT CABLE

FIELD OF THE INVENTION

The present invention relates to electronic musical instrument cables and audio cables and, more particularly, to musical instrument cables and audio cables that will freely and noiselessly rotate 360 degrees.

BACKGROUND OF THE INVENTION

While standing up and playing the electric guitar, the audio cable which connects the guitar to either the amplifier tends to get twisted up from walking back and forth and occasionally turning around. I would have to unplug the cord from either connected end and unwind it several times per hour during playing. A twisted up cord is greatly reduced in usable length and also tends to get easily caught up on other nearby objects like the floor effects boxes, microphone stands and whatever else may be in the way, instead of just laying flat and manageable as when it was first plugged in. People tend to turn around going in the same direction just as they will typically start into a staircase using the same lead foot of preference. Once the cord is twisted up, it must be unplugged from either the guitar end or the destination end and untwisted or else you would have to twirl around in a circle the opposite direction many, many times. Both of those solutions are undesirable for obvious reasons. I thought there must be a freely rotateable cord available for purchase, so I began searching the internet, musical instrument supply catalogs and my local music stores. I was unable to find anything at all like that for musical instruments and not even any mention of anything close in any discussions or articles on the internet. I've also never seen anything remotely close in any of several hundred music magazines that I've received over the last few decades.

Upon further searching for a solution to my problem, I came across a ball bearing action, rotating connector that uses mercury, a liquid conductive metal, to make the connections between the two moving contacts within the rotating connector. This connector is primarily aimed for industrial uses, as is suggested on their website. This particular rotating connector is made by Mercotac, of Carlsbad, Calif., model 205 series. By splitting a typical coaxial electric guitar cable and connecting the Mercotac 205 rotating connector inline with the length of the electric guitar cable, it would allow for quiet and free rotation of the cable while performing. The mercury provides noise-free, moving contact within the connector with virtually no mechanical resistance and extremely low electrical resistance, which is of great benefit to an audio signal passing through it.

Another benefit of this device is extended life of the cable since the twisting action subjected to regular cables eventually breaks down the internal copper wires and causing breakage and failure of the connection.

I have built a prototype which I use almost daily and it has worked flawlessly.

One existing alternate solution is use of a wireless device. These are commonly used by musicians worldwide. Another attempt at solving this problem is shown in prior art of U.S. Pat. No. 5,419,707, issued to Kelley for Swivel Electrical Connector. Other various older swivel connector patents such as prior art of U.S. Pat. No. 4,590,337, issued to Engelmore for Rotatable Electrical Connector for Coiled Telephone Cords also exists.

The shortcomings of the wireless devices are that they are costly, complicated and delicate. A receiver must be placed somewhere nearby with an audio cable leaving it, connecting it to where you would like your audio signal to end up. The receiver also requires power, usually in the form of an A/C power adapter and cord commonly called a "wall wart". Then, you must wear a transmitter which is run by batteries that will only last a few hours. Typically, batteries are needing changing before each live performance since you never know how much life is left in the battery. Having a battery die in the middle of a performance would be very bad. The transmitter has a cord coming out of it which plugs into the instrument. Both the receiver and transmitter are sensitive, delicate devices prone to damage if mishandled. Also, many of these devices have volume adjustments, transmit and receive frequency selection and sometimes squelch controls which make them more complicated than cables and do not always deliver a clean and accurate audio signal.

The prior art, U.S. Pat. No. 5,419,707, issued to Kelley for Swivel Electrical Connector, does not appear to be available for sale, possibly, because of some of the following problems. Kelley's Swivel Connector would need to be attached at either the guitar/instrument end of a cable or the destination end, either an amplifier or an effects box on the floor or similar device, and not along the length of the cable where the twisting is occurring. At the guitar end of a typical cable, most all guitar player that I've ever seen will first pass the cable between the where their guitar strap contacts the butt end of the guitar. This strain reliefs the cable from being kicked out of the connector jack of the instrument, should they step on the cord which is hanging down near their feet. This strain reliefing of the cable would prevent Kelley's Swivel Electrical Connector from being able to release the twisting of the cable since the cable is being pinched between the guitar body and guitar strap, beyond his connector. Also, if the Kelley's Swivel Connector is instead placed at the destination end, the weight of several feet of cable laying on the floor before reaching its destination, would in most cases prevent it from freely rotating around and relieving the cable stress since the twisting energy is focused near the player where the cable is hanging from the instrument. Thus, my Rotatable Musical Instrument Cable is a rotating cable rather than a rotating connector on either end of a cable.

Another greater problem is that the prior art swivel connector uses electrically conductive mechanical wiper pads and contacts, similar to common slip ring connectors, to make the electrical connections. This would make for more physical resistance, more physical wear and tear internally, and also generate electrical noise as the contacts get dirty from the wearing action. Many musicians use high gain amplification that would make even the smallest of electrical noises very noticeable to the listener. Mechanical slip ring type connections will work fine for many industrial types of moving electrical connections, but would not be very useful to sensitive instrumentation devices or critical audio paths. The ball bearing action and mercury electrical connections within the Mercotac 205 part that I am using, as well as the rotating part of it being placed along the length of the cable near the user, make my Rotatable Musical Instrument Cable far superior to Kelley's Swivel Electrical Connector. My invention rotates easily and makes no noise at all even with extremely high gain amplification, Prior art of U.S. Pat. No. 4,590,337, issued to Engelmore for Rotatable Electrical Connector for Coiled Telephone Cords, uses the slip ring contact and wiper method on the moving electrical connections and carries similar drawbacks as the aforementioned device by Kelley.

It is therefore an object of the invention to connect an electric guitar, bass or other musical instrument or audio device to another piece of musical or audio equipment.

It is another object of the invention to be able to rotate freely during use, so as not to twist up.

It is another object of the invention to be noiseless during its operation.

It is another object of the invention to have very low electrical resistance in the audio path.

It is another object of the invention to increase the life of the instrument cable by reducing the fatigue to the internal cable wires that is normally caused by the cable getting twisted up.

SUMMARY OF THE INVENTION

In accordance with the present invention, there is provided a musical instrument coaxial cable that is functional for use when walking around while playing an electric guitar or other instrument. The cable starts with a typical audio connector plug on one end and connects to a length of coaxial cable, sufficient to loop through the guitar strap and butt end of the guitar for strain relief. The coaxial cable is then electrically and mechanically attached to a Mercotac receptacle connector. This then press fits into a Mercotac 205 rotating electrical connector. The other end of the Mercotac 205 then attaches in a similar fashion to another Mercotac receptacle connector and another length of coaxial cable and audio connector plug on the end of the cable. Where the coaxial cable is electrically connected to the Mercotac receptacle connectors, there should be electrical shielding placed around the attached wires to prevent induced electrical noise to be injected into the cable wiring. This may be done with metal foil tape or some other effective means of shielding. Covering part of the receptacle, all of the shielding, and also part of the coaxial cable jacket, should be placed a length of heat-shrink-tubing or other insulating material to protect and strengthen that area of the cabling where the attachment has been made to the Mercotac receptacle connector.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
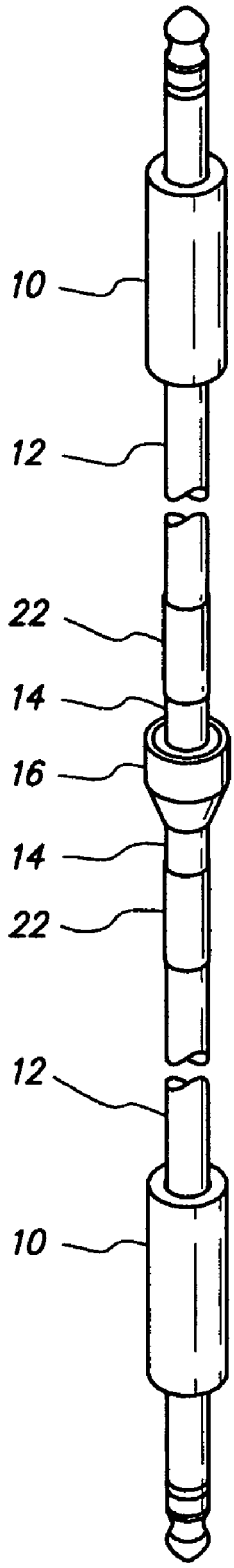
FIG. 1 is a perspective view of a rotatable musical instrument cable in accordance with the invention.

FIG. 1 is a perspective view of a rotatable audio and musical instrument cable invention.

Solder, crimp or otherwise suitably connect the center conductor of the coaxial cord 12 to the connection point of the audio connector plug 10 that connects with the tip of plug 10. The shield or outer braid of cord 12 is soldered or otherwise suitably attached to the shielding ground connection point of the plug 10. The rotatable connector receptacle 14 is similarly connected to the other end of the cord 12 with an insulator covering the soldered center conductor of the receptacle 14 and the cord 12 center conductor joint. Foil shielding is installed covering the entire connection area between the cord 12 and the receptacle 14. Covering the foil shielding is a length of heat shrink tubing 22. Sufficient heat should be administered to the tubing 22 to contract the tubing 22 around the foil shielding. A mirror image of the above described cable should be constructed. Both the receptacle 14 ends of the mirror imaged cables are to be press fit onto each end of the rotatable connector 16.

Figure 2:
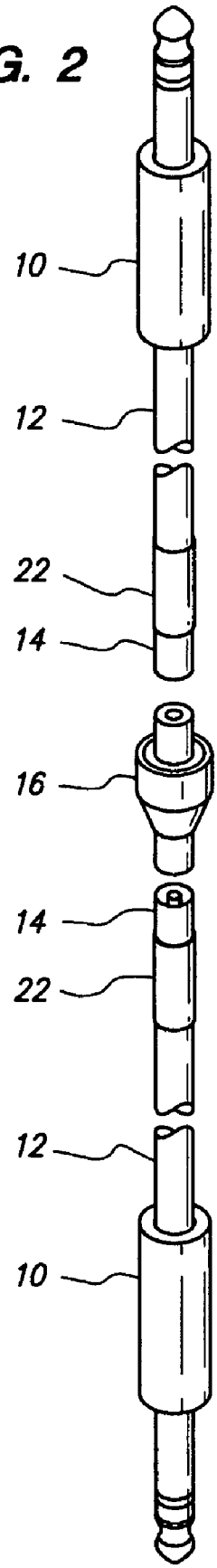
FIG. 2 is an exploded view of the rotatable musical instrument cable shown in FIG. 1.

FIG. 2 is an exploded view of FIG. 1.

Figure 3:
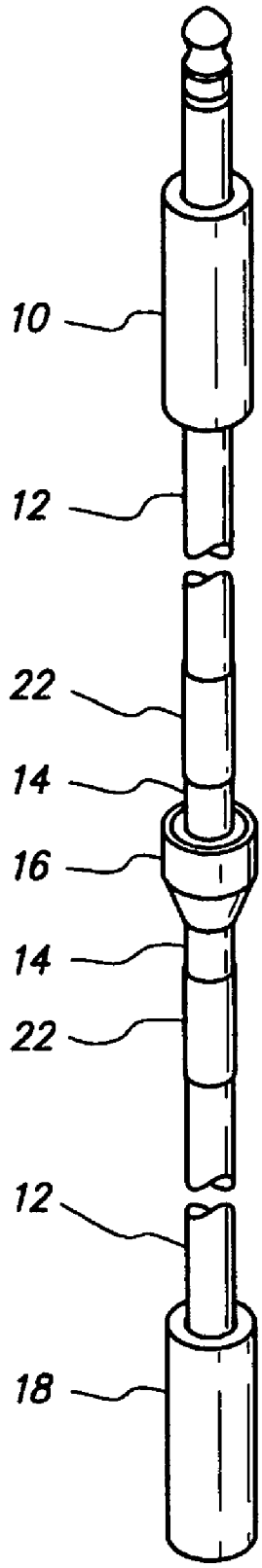
FIG. 3 is a perspective view of an alternate embodiment 1 of FIG. 1.

FIG. 3 is a perspective view of Alternate Embodiment 1 of the Rotatable Musical Instrument Cable shown in FIG. 1. At one end of the Cable, the plug 10 is replaced with an audio connector jack 18, enabling the user plug an existing audio cable into the Rotatable Musical Instrument Cable, This would allow the existing regular cable to rotate.

Figure 4:
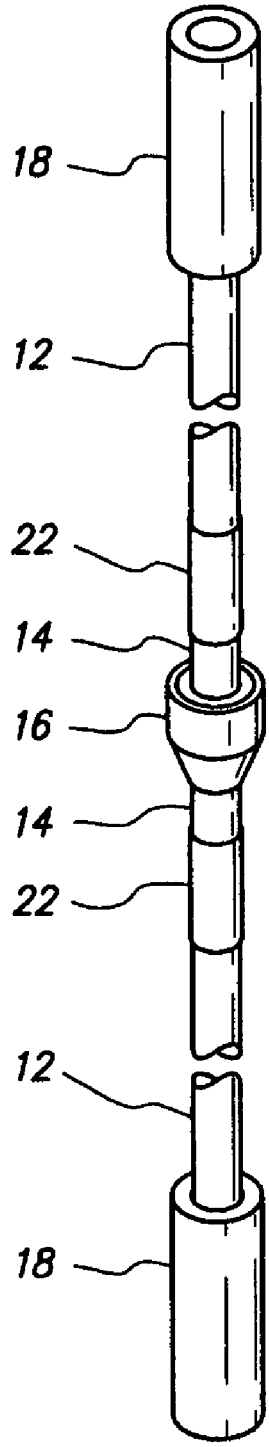
FIG. 4 is a perspective view of an alternate embodiment 2 of FIG. 1.

FIG. 4 is a perspective view of Alternate Embodiment 2 of the Rotatable Musical Instrument Cable shown in FIG. 1. Both plugs 10 are substituted with jacks 18 so that the rotatable audio cable can be connected between two existing audio cables and enabling rotation of the existing cables.

Figure 5:
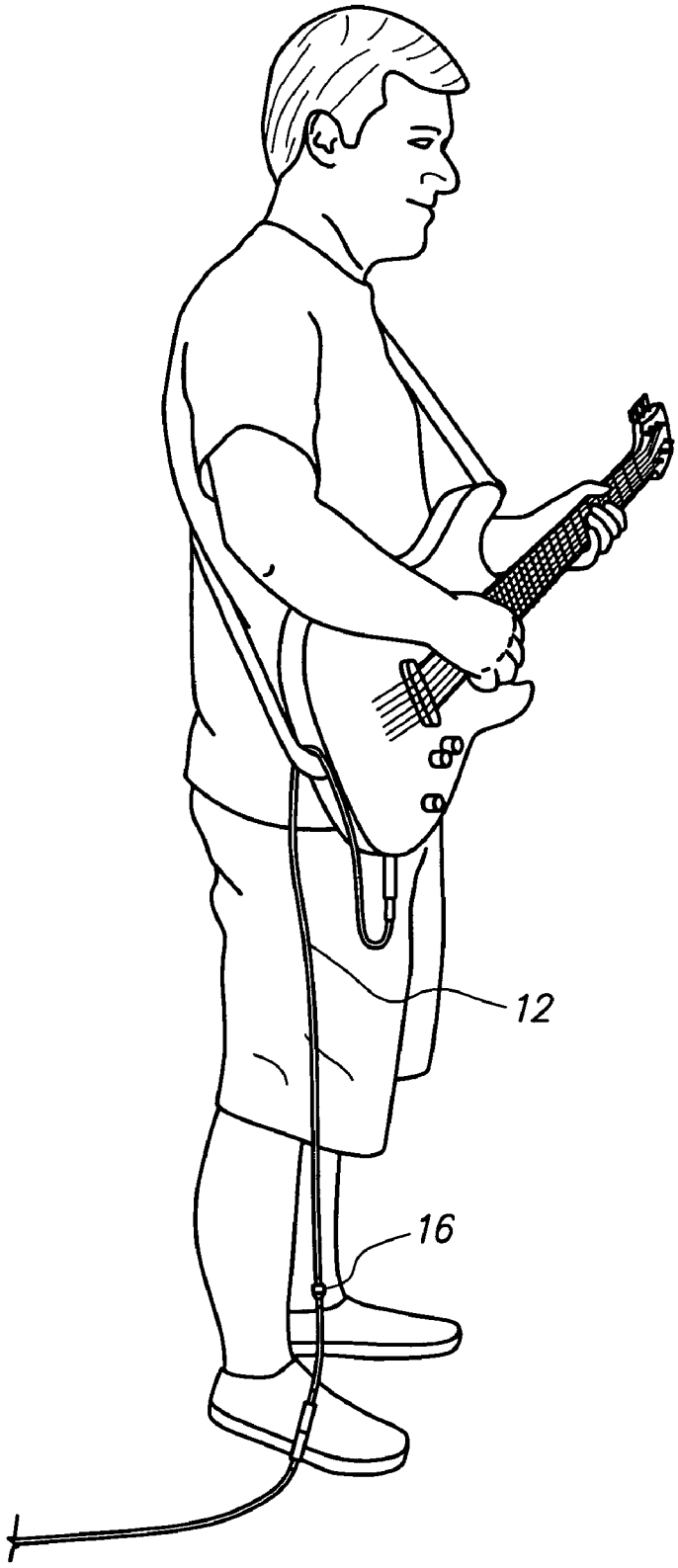
FIG. 5 is a life view of a rotatable musical instrument cable in use.

FIG. 5 shows a life view of the Rotatable Musical Instrument Cable in use.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A rotatable audio and musical instrument cable for connecting an audio device or electronic musical instrument to other equipment with a cable that will rotate 360 degrees by using a mercury contact, rotatable electrical connector which is incorporated into a cable, comprising:

a rotatable, noiseless, coaxial rotatable connector, for providing a 360 degree rotatable, shielded electrical connector, which uses mercury to make electrical contact between moving conductors within said connector;

a coaxial cord, for carrying a shielded electrical signal from one point to another;

a metal, plurality of contacts audio connector plug, for connecting devices to an electrical cable for the transmission of an electrical signal, electrically connected to said coaxial cord; and a metal, plurality of contacts audio connector jack, for replacing one or both audio connector plug elements on the invention with audio connector jacks so that other cables can be inserted into said audio connector jacks, thereby creating a rotatable cable using other existing cables.

2. A rotatable audio and musical instrument cable for connecting an audio device or electronic musical instrument to other equipment with a cable that will rotate 360 degrees by using a mercury contact, rotatable electrical connector which is incorporated into a cable, comprising:

means for providing a 360 degree rotatable, shielded electrical connector, which uses mercury to make electrical contact between moving conductors within said connector;

means for carrying a shielded electrical signal from one point to another;

means for connecting devices to an electrical cable for the transmission of an electrical signal, electrically connected to said means for carrying a shielded electrical signal from one point to another; and means for replacing one or both audio connector plug elements on the cable with audio connector jacks so that other cables can be inserted into said audio connector jacks, thereby creating a rotatable cable using other existing cables.

3. The rotatable audio and musical instrument cable in accordance with claim 2, wherein said means for providing a 360 degree rotatable, shielded electrical connector, which uses mercury to make electrical contact between moving conductors within said connector comprises a rotatable, noiseless, coaxial rotatable connector.

4. The rotatable audio and musical instrument cable in accordance with claim 2, wherein said means for carrying a shielded electrical signal from one point to another comprises a coaxial cord.

5. The rotatable audio and musical instrument cable in accordance with claim 2, wherein said means for connecting devices to an electrical cable for the transmission of an electrical signal comprises a metal, plurality of contacts audio connector plug.

6. The rotatable audio and musical instrument cable in accordance with claim 2, wherein said means for replacing one or both audio connector plug elements on the invention with audio connector jacks so that other cables can be inserted into said audio connector jacks, thereby creating a rotatable cable using other existing cables comprises a metal, plurality of contacts audio connector jack.

* * * * *